US005718867A

United States Patent [19]

Nazmy et al.

[11] Patent Number: 5,718,867

[45] Date of Patent: Feb. 17, 1998

[54] ALLOY BASED ON A SILICIDE CONTAINING AT LEAST CHROMIUM AND MOLYBDENUM

[75] Inventors: Mohammed Nazmy, Fislisbach; Corrado Noseda, Remetschwil; Markus Staubli, Dottikon, all of Switzerland

[73] Assignee: Asea Broan Boveri AG, Baden, Switzerland

[21] Appl. No.: 530,091

[22] Filed: Sep. 19, 1995

[30] Foreign Application Priority Data

Oct. 17, 1994 [EP] European Pat. Off. ..... 94116323

[51] Int. Cl.[6] ..... C22C 27/06; C22C 30/00

[52] U.S. Cl. ..... 420/428; 420/429; 420/588; 148/407; 148/409

[58] Field of Search ..... 420/428, 429, 420/588; 148/407, 419, 423, 442

[56] References Cited

U.S. PATENT DOCUMENTS 3,174,853 3/1965 Sims et al. ..... 420/428

5,330,590 7/1994 Raj ..... 420/588

5,454,884 10/1995 Hashimoto et al. ..... 420/428

FOREIGN PATENT DOCUMENTS

0425972B1 10/1990 European Pat. Off. .

OTHER PUBLICATIONS

Derwint abstract of WO 9307302, 1993.

"A Preliminary Assessment of the Properties of a Chromium Silicide Alloy for Aerospace Applications", S.V. Raj, Mater.Sci.Eng. and Proc. 3rd. Intern. Conf. on High-Temperature Intermetallics, May 9, 1994.

*Primary Examiner*—David A. Simmons

*Assistant Examiner*—Margery S. Phipps

*Attorney, Agent, or Firm*—Burns, Doane, Swecker & Mathis, L.L.P.

[57] ABSTRACT

An alloy based on a silicide containing at least chromium and molybdenum contains the following constituents in atomic percent: chromium 41–55, molybdenum 13–35 and silicon 25–35, or chromium 35–55, molybdenum 13–35, silicon 13–35, yttrium 0.001–0.3, and/or tungsten 0.001–10. This alloy is distinguished by a high oxidation resistance and still has a mechanical strength at temperatures of over 1000° C. which favors its use as structural material in gas turbines.

9 Claims, No Drawings

ALLOY BASED ON A SILICIDE CONTAINING AT LEAST CHROMIUM AND MOLYBDENUM

BACKGROUND OF THE INVENTION

1. Field of the Invention

Alloys based on a silicide containing at least chromium and molybdenum are distinguished at high temperatures by high oxidation resistance and corrosion resistance and can be used in thermally heavily loaded parts exposed to oxidizing and/or corrosive actions in heat engines. At the same time, it is of additional advantage for the use of said alloys as structural material that they have a lower density than the nickel-base superalloys normally used.

2. Discussion of Background

An oxidation-resistant and corrosion-resistant alloy based on a silicide containing at least chromium and molybdenum is described in EP 0 425 972 B1. In preferred embodiments, said alloy has a chromium content of 60 atomic percent and over and is then distinguished by a high mechanical strength at temperatures up to 1000° C., accompanied by good oxidation resistance and corrosion resistance. However, for certain practical applications, the oxidation resistance of said alloy is still inadequate.

A further alloy based on a silicide containing at least chromium and molybdenum is disclosed in the report prepared by S. V. Raj, NASA Lewis Research Center, Cleveland/Ohio entitled "A Preliminary Assessment of the Properties of a Chromium Silicide Alloy for Aerospace Applications" (submitted to Mater. Sci. Eng. and Proc. 3rd International Conf. on High-Temperature Intermetallics, May 9, 1994). In the case of the alloy $Cr_{40}Mo_{30}Si_{30}$ described in this report, a particularly good oxidation resistance was observed compared with other silicides. It is, however, pointed out that a practical use of said alloy is inconceivable owing to an extremely low ductility.

SUMMARY OF THE INVENTION

Accordingly, one object of the invention is to develop a novel alloy based on a silicide containing at least chromium and molybdenum, which has an outstanding oxidation resistance and good mechanical properties at temperatures of over 1000° C. The alloy preferably includes, in atomic %, 48–53% Cr, 13–20% Mo, and 30–35% Si.

The alloy according to the invention is distinguished by the fact that it has a considerably improved oxidation resistance at temperatures around 1250° C. compared with comparable known alloys based on a silicide containing at least chromium and molybdenum. In addition, its ductility and mechanical strength at high temperatures are sufficient to favor particularly its suitability as structural material in components which are exposed in an oxidizing and/or corrosive atmosphere to temperatures of 1000 to 1400° C. In addition, the alloy according to the invention can be produced inexpensively by melting and casting.

DESCRIPTION OF THE PREFERRED EMBODIMENTS

The invention is described in greater detail below with reference to exemplary embodiments.

Alloys of the composition specified in atomic percent in the table below were prepared by melting in an induction furnace under protective gas, such as, in particular, under argon, or under vacuum, from the elements which were present in specified stoichiometric ratios.

| Alloy | A | B | C | D | E | F | G |
|---|---|---|---|---|---|---|---|
| Chromium | 60 | 60 | 51 | 50 | 50 | 40 | 53 |
| Molybdenum | 15 | 15 | 14 | 15 | 15 | 30 | 13 |
| Silicon | 25 | 25 | 35 | 30 | 30 | 30 | 34 |
| Tungsten | — | — | — | 5 | 5 | — | — |
| Yttrium | — | 0.05 | — | — | 0.02 | 0.02 | — |

The melts were cast to form castings having a diameter of approximately 40 mm and a height of approximately 50 mm. From these, platelets having a surface area of approximately 1 $cm^2$ and a thickness of approximately 1–2 mm were produced to determine the oxidation resistance and specimens were produced for upsetting tests and stress rupture tests.

Platelets of the alloys A–F produced from the castings were heated under air to 1250° C. The loss or increase in mass of each of the platelets caused by oxidation and/or corrosion in this process was determined thermogravimetrically after 12 h 40 min and, in some cases, additionally also after 100 h. The loss or increase in mass δW [mg], based on the size of the surface area $A_0$ [$cm^2$] of each of the platelets, is then a measure of the oxidation resistance and corrosion resistance of the alloys A–F and is listed in the table below.

| | $\delta W/A_0$ [$mg/cm^2$] | |
|---|---|---|
| Alloy | after 12 h 40 min | after 100 h |
| A | 2.5 | — |
| B | 3.7 | — |
| C | 0.5 | 0.8 |
| D | 0.6 | 3.2 |
| E | 1.1 | 3.1 |
| F | 0.5 | 3.8 |

From this it can be seen that the alloy A, which served as a comparison alloy, and the alloy B, which has a relatively large addition of yttrium, have a substantially reduced oxidation resistance and corrosion resistance compared with the alloys C–F according to the invention. The alloy C, whose loss or increase in mass changes only slightly between 12 h 40 min and 100 h has a particularly advantageous oxidation resistance.

Modifications of the alloy C, in which the chromium content is less than 55, preferably less than 53, and greater than 41, preferably greater than 48, atomic percent, the molybdenum content is less than 35, preferably less than 20, and greater than 13 atomic percent and the silicon content is less than 35 and greater than 25, preferably greater than 30, atomic percent, also have good oxidation resistance. Modifications of the alloy F containing 35–55 atomic percent, of chromium, 13–35 atomic percent of molybdenum, 0.001–0.3 atomic percent of yttrium and/or 0–10 atomic percent of tungsten also still have a sufficiently good oxidation resistance. As a result of adding tungsten and/or yttrium by alloying to the slightly modified alloy C (alloys D and E) the oxidation resistance, although somewhat reduced compared with the alloy C, surpassed the oxidation resistance of alloys according to the prior art quite considerably and at the same time a particularly good mechanical strength was achieved.

The specimens for the stress rupture tests were heated to 1300° C. and the true creep rate at this temperature was determined as a function of the true stress. In these tests, it was found that the creep strength was doubled or even tripled by adding tungsten and/or yttrium by alloying.

The ductility of the alloy according to the invention was determined indirectly from the upsetting tests. In these, the specimens provided for upsetting tests were upset at temperatures of 1100, 1200, 1300 and 1400° C. and the upsetting pressure was determined at each temperature at the 0.2% tensile yield strength. This yielded the values of the upsetting pressure listed in the table below:

| Temperature | Pressure at the 0.2% tensile yield strength [MPa] | | | |
|---|---|---|---|---|
| | Alloy | | | |
| [°C.] | C | D | E | G |
| 1100 | 795 | — | — | — |
| 1200 | 507 | — | — | 625 |
| 1300 | 351 | 374 | 601 | 396 |
| 1400 | 204 | 199 | 348 | 214 |

Obviously, it was still possible to achieve a 0.2% tensile yield strength at the comparatively low temperature of 1100° C. only in the case of the particularly preferred alloy C. This alloy is therefore distinguished by a particularly good ductility. A 0.2% tensile yield strength was still achieved at 1200° C. in the case of the alloy G situated in the preferred range of stoichiometric composition. This alloy is therefore also distinguished by a relatively good ductility. As a result of the strength-increasing additives tungsten and/or yttrium (alloys D and E), there is a 0.2% tensile yield strength only at a temperature of 1300° C. but a particularly high strength is achieved by adding 2 to 8 atomic percent of tungsten by alloying and, in particular, by adding 2 to 8 atomic percent of tungsten and 0.001 to 0.3 atomic percent of yttrium by alloying to the alloy C or an alloy modified in a preferred manner and containing 48–53 atomic percent of chromium, 13–20 atomic percent of molybdenum and 30 to 35 atomic percent of silicon.

Obviously, numerous modifications and variations of the present invention are possible in light of the above teachings. It is therefore to be understood that within the scope of the appended claims, the invention may be practiced otherwise than as specifically described herein.

What is claimed is:

1. An alloy based on a silicide consisting essentially of chromium, molybdenum and silicon, in atomic percent:

chromium 48–53, molybdenum 13–20 and silicon 30–35.

2. An alloy as claimed in claim 1, exhibiting a weight gain after exposure to air at a temperature of 1250° C. for 12 hours and 40 minutes of no more than 1.1 mg/cm$^2$.

3. An alloy as claimed in claim 1, exhibiting a weight gain after exposure to air at a temperature of 1250° C. for 100 hours of no more than 3.2 mg/cm$^2$.

4. An alloy as claimed in claim 1, wherein the alloy consists essentially of Cr, Mo, Si and 0.001 to 0.3 atomic % Y.

5. An alloy as claimed in claim 1, which additionally contains 2–8 atomic percent of tungsten.

6. An alloy as claimed in claim 1, wherein the alloy consists essentially of Cr, Mo, Si and about 5 atomic % W.

7. An alloy as claimed in claim 5, which additionally contains 0.001–0.3 atomic percent of yttrium.

8. An alloy as claimed in claim 1, wherein the alloy consists essentially of Cr, Mo, Si, 2 to 8 atomic % W and 0.02 to 0.05 atomic % Y.

9. A structural member exposed to an oxidizing atmosphere at temperatures of 1000 to 1400° C., the structural member comprising an alloy based on a silicide consisting essentially of chromium, molybdenum and silicon, in atomic percent:

chromium 48–53, molybdenum 13–20 and silicon 30–35.

* * * * *

UNITED STATES PATENT AND TRADEMARK OFFICE
CERTIFICATE OF CORRECTION

PATENT NO. : 5,718,867

DATED : February 17, 1998

INVENTOR(S) : Mohammed Nazmy, et al.

It is certified that error appears in the above-identified patent and that said Letters Patent is hereby corrected as shown below:

[73] Assignee: Asea Broan Boveri AG, Baden, Switzerland should read

[73] Assignee: Asea Brown Boveri AG, Baden, Switzerland

Signed and Sealed this

Fifth Day of May, 1998

*Attest:*

*Attesting Officer*

BRUCE LEHMAN

*Commissioner of Patents and Trademarks*